US006913632B1

(12) United States Patent
Ling

(10) Patent No.: US 6,913,632 B1
(45) Date of Patent: Jul. 5, 2005

(54) GASIFIERS WITH NON RADIAL TUYERES

(75) Inventor: Michael John Archer Ling, Sudbury (GB)

(73) Assignee: Dedar Limited, London (GB)

( * ) Notice: Subject to any disclaimer, the term of this patent is extended or adjusted under 35 U.S.C. 154(b) by 0 days.

(21) Appl. No.: 09/701,217

(22) PCT Filed: May 27, 1999

(86) PCT No.: PCT/GB99/01671

§ 371 (c)(1),
(2), (4) Date: Nov. 27, 2000

(87) PCT Pub. No.: WO99/61561

PCT Pub. Date: Dec. 2, 1999

(30) Foreign Application Priority Data

May 28, 1998 (GB) ..... 9811415

(51) Int. Cl.[7] ..... C10J 3/26
(52) U.S. Cl. ..... 48/77; 48/92
(58) Field of Search ..... 48/63, 77, 92, 48/101, 111, 200, 202, 209, 210, 197 FM

(56) References Cited

U.S. PATENT DOCUMENTS 4,507,174 A * 3/1985 Kutrieb ..... 202/97
4,583,992 A * 4/1986 Rogers ..... 48/76
5,823,122 A * 10/1998 Chronowski et al. ..... 110/346

FOREIGN PATENT DOCUMENTS

CH A-237 348 * 8/1945
NL A-89 00939 * 11/1990

* cited by examiner

*Primary Examiner*—Samuel M. Heinrich
(74) *Attorney, Agent, or Firm*—Andrus, Sceales, Starke & Sawall, LLP

(57) ABSTRACT

A gasifier for the manufacture of producer gas has a chamber (10) for the combustion of material, the chamber (10) being provided with a plurality of tuyeres (30) for the introduction of combustion air to the chamber. The tuyeres (30) are disposed at an acute angle to the wall of the chamber (10) so that air is directed both around and upwardly of the chamber. Each tuyeres (30) is configured to produce a jet stream wherein the air swirls along the length of the stream.

16 Claims, 3 Drawing Sheets

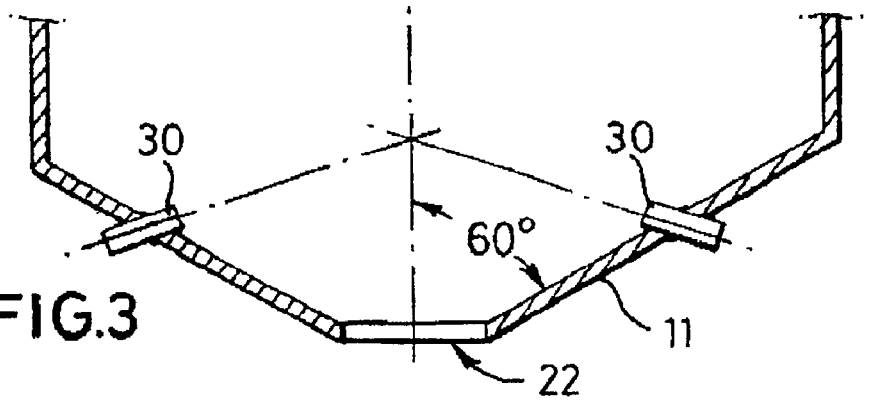
FIG.3
FIG.4
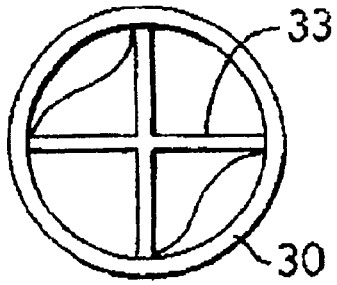
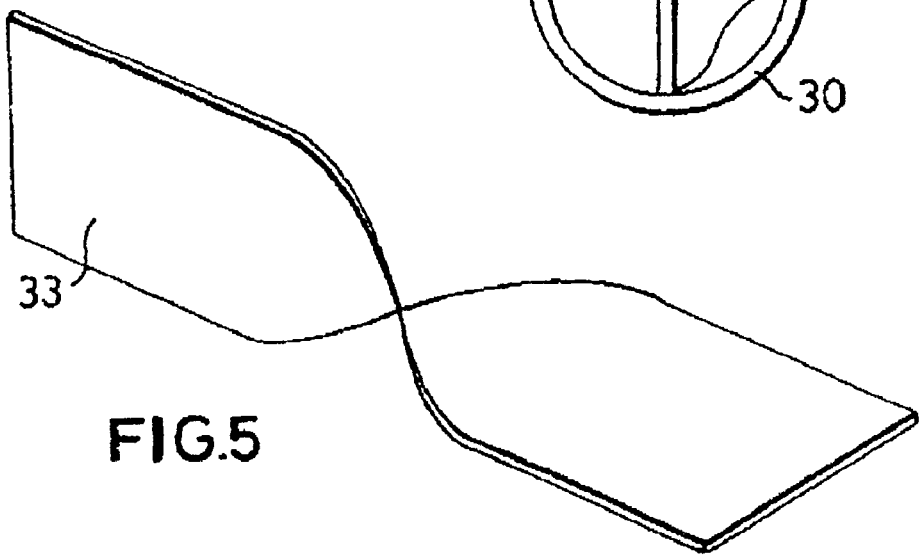
FIG.5

GASIFIERS WITH NON RADIAL TUYERES

CROSS REFERENCE TO RELATED APPLICATION

The present application is the U.S. National Stage Application of International Application PCT/GB99/01671, filed May 27, 1999, which international application was published on Dec. 2, 1999 as International Publication WO99/61561 in the English language. The International Application claims priority of Great Britain Application 9811415.0, filed May 28, 1998.

BACKGROUND OF THE INVENTION

This invention relates to gasifiers and in particular to improvements in or relating to gasifiers whereby improved combustion may take place therewithin. The invention further relates to a method of operating a gasifier.

The production of producer gas (a mixture of about 30% carbon monoxide and 70% nitrogen, though other gases may also be present) is usually performed with a so-called gasifier, in which pyrolysis is performed. The gasifier comprises a chamber provided with air inlets in such a way that the burning of fuel within the chamber take place under controlled conditions. Originally, gasifiers used coal or coke as a fuel source, but interest in gasifiers has recently increased since they may be used for the disposal of various kinds of waste organic solid matter whilst yielding producer gas, which in turn may drive a combined heat and power unit, to yield both heat and electricity. Thus, the solid fuel may typically comprise wood or wood derivatives, straw, poultry litter, dried sewage sludge and refuse-derived combustible material, to mention but a few.

In a gasifier chamber, the solid fuel is reduced to a bed of carbon at a temperature of above 1000° C., a stream of air being passed through the bed with the combustion conditions set so that the oxygen in the air combines with the carbon to form carbon monoxide. Other gases such as methane and hydrogen may also be produced, depending upon the chemical composition of the fuel employed.

A product of the combustion in a gasifier is ash, but this is of relatively low density and of small volume compared to the solid fuel supplied to the gasifier. It is consequently relatively easy to dispose of, especially since it is wholly sterile. By contrast, the producer gas may be used for a variety of purposes, though since it is toxic in view of the carbon monoxide content, it must nevertheless be treated with care. For example, the collected producer gas may immediately be used in an internal combustion engine for the generation of electricity, without being stored for long periods or otherwise handled.

Though the principle upon which a gasifier operates is well known and understood, it is important that the combustion conditions are closely controlled in order that the production of carbon monoxide is optimised and that the carbon dioxide content of the producer gas is minimised. It has now been established that by controlling the actual introduction of air into the oxidation zone of a gasifier, it is possible to improve the gasifier performance, so increasing the overall efficiency of plant using this equipment.

Gasifier designs have been proposed in NL-A8900939 and CH-A-237348. In both of these prior designs, arrangements are made to introduce combustion air into a gasifier in such a way that the air is not directed strictly radially with respect to the axis of the combustion chamber, in an attempt to enhance combustion within the chamber. The present invention stems from attempts further to improve the production of producer gas.

SUMMARY OF THE INVENTION

According to one aspect of the present invention, there is provided a gasifier for the production of producer gas from combustible material, comprising a chamber into which said material is introduced and a plurality of tuyères disposed at or adjacent the lower end of the chamber for the introduction of air into the combustion chamber, each such tuyère defining an axis along which air is projected into the chamber, at least some of the tuyères being configured to impart a rotational motion about said axis along which the air is projected into the chamber from each such tuyère, whereby the combustion air is projected in the form of a jet stream which swirls about the length of the stream.

Preferably, at least some of the tuyères are disposed with their respective axes at an acute angle (when projected on to a horizontal plane containing the respective tuyère) to a tangent to the wall of the chamber at the location of that tuyère, the axis of projection of each said tuyère being in the same sense with respect to the axis of the chamber, whereby the projected air also tends to swirl around the chamber.

It will be appreciated that the gasifier of this invention is able to achieve better reduction of the fuel, by improving the interaction between the introduced air and the hot carbonised bed at the bottom of the gasifier chamber. This interaction may be achieved either solely by causing the introduced air to rotate along the axis of projection into the gasifier, or by additionally causing the introduced air to swirl around the lower region of the chamber. By adopting both of these measures of this invention, the interaction of the air with the bed at the bottom of the gasifier is much enhanced, so giving better control of the combustion of the fuel. In turn, this leads to more complete combustion in the oxidation zone, giving a greater oxygen deficiency in the reduction zone and raising the proportion of carbon monoxide in the resultant producer gas.

Most preferably, all of the tuyères lie at substantially the same acute angle to the chamber wall where the respective tuyère projects therethrough. Thus, by having the angle of projection of each said tuyère in the same sense with respect to the axis of the chamber, the introduced air tends to swirl around the chamber interacting with all portions of the relatively hot carbon bed. This effect is enhanced by providing the tuyères in a uniform distribution equi-spaced around the chamber.

Advantageously, each tuyère is directed both at a non radial angle to the axis of the chamber and also upwardly of the chamber. In this way, penetration of the entire hot carbon bed by the introduced air may be assured.

The chamber may be of general circular cross-sectional shape, at least in the region of the tuyères, with the axis of the chamber extending generally vertically. That chamber may have a lower wall of a generally conical shape and which supports a bed of the combustible material, said tuyères being mounted in that lower conical wall. At the other end of the chamber, there may be provided an inlet orifice for combustible material, the upper portion of the chamber serving as a hopper for the material loaded thereinto. The inlet orifice advantageously is fitted with a slide valve, to permit charging of the hopper whilst the gasifier is in operation.

Each tuyère is preferably in the form of a nozzle projecting through the chamber wall, the bore of the nozzle being configured to cause the air flow therethrough to rotate about its length. This may be achieved by providing an insert within each said nozzle, the insert comprising a plate the width of which is substantially the same as the nozzle internal diameter and the plate being twisted along its length.

This invention extends to a method of operating a gasifier for the production of producer gas from combustible material, which gasifier comprises a chamber into which said material is introduced and a plurality of tuyères disposed at or adjacent the lower end of the chamber, in which method air is introduced into the combustion chamber through the tuyères and each tuyère is configured to impart a rotational motion about the axis of introduction of the air so that the combustion air is projected in the form of a jet stream which swirls about the length of the introduced stream. In addition, the invention provides for the air being introduced through tuyères at least some of which have their respective axes at an acute angle (when projected onto a horizontal plane containing the respective tuyère) to a tangent to a wall of the chamber at the location of that tuyère, whereby the air will tend to swirl around the chamber, simultaneously with the rotation of the air about its own axis.

BRIEF DESCRIPTION OF THE SEVERAL VIEWS OF THE DRAWINGS

By way of example only, one specific embodiment of gasifier constructed and arranged in accordance with the present invention will now be described in detail, reference being made to the accompanying drawings in which:

FIG. 3 is a detailed view on an enlarged scale through said lower wall;

FIG. 4 is an end-view on a tuyère of the gasifier of FIGS. 1 to 3; and FIG. 5 illustrates an insert plate of the tuyère nozzle of FIG. 4.

DETAILED DESCRIPTION OF THE INVENTION

Figure 1:
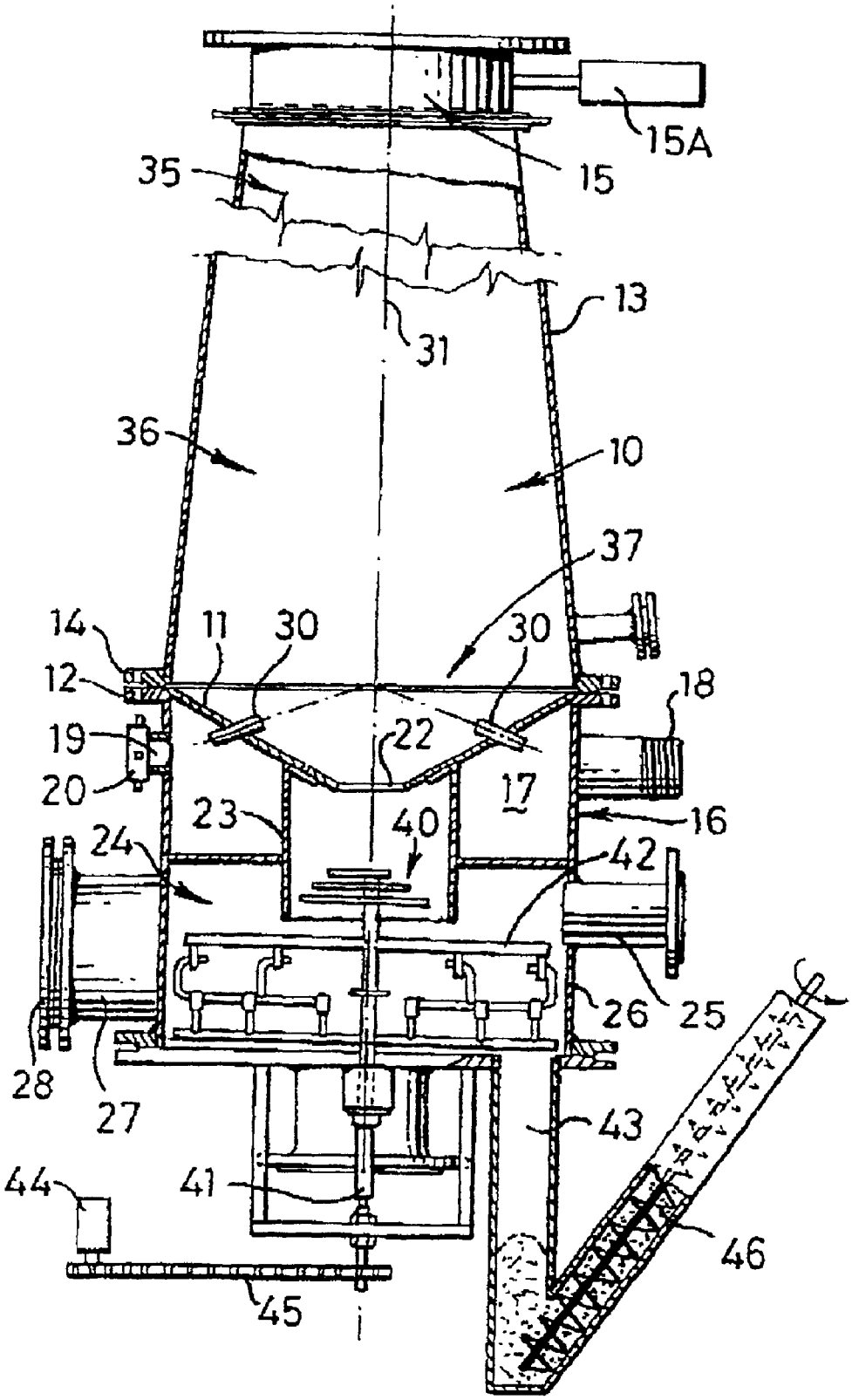
FIG. 1 is a diagrammatic vertical section through the embodiment of the gasifier.

Referring initially to FIG. 1, there is shown diagrammatically an embodiment of gasifier arranged for the production of producer gas from a solid combustible material serving as a fuel, such as wood chippings, logs, coal or similar materials, poultry litter, dried sewage sludge or a refuse derived fuel. The gasifier comprises a combustion chamber 10 having a generally conical lower wall 11 provided with a flange 12 around its upper periphery. A hopper 13 has a corresponding flange 14 at its lower periphery and which is secured by bolts (not shown) to flange 12 of the lower wall 11. The upper end of the hopper 13 is closed by a slide valve assembly 15, which permits recharging of the hopper with more solid fuel whilst operation of the gasifier continues. An actuator 15A is mounted to one side of the hopper, to effect opening and dosing of the slide valve assembly.

In an alternative arrangement (not shown) the hopper has a simple lid which may be secured in position and a fuel feed arrangement may be provided to supply fuel into the upper part of the hopper.

The lower wall 11 is carried on a base structure 16 which defines a plenum chamber 17 provided with an air inlet 18 and six lighting ports 19, each normally closed by a respective cap 20, the ports 19 being equi-spaced around the plenum chamber 17. The central region of the lower wall 11 communicates through opening 22 with a tube 23 within which the producer gas is formed during operation of the gasifier, the tube 23 leading to a lower chamber 24. A producer gas outlet pipe 25 passes through an outer wall 26 of the lower chamber 24 and there is provided a port 27 to that chamber, normally closed by a blanking plate 28 but through which access to the chamber may be gained for example for ash removal and servicing.

An automated ash removal system is fitted below the tube 23. This comprises an eccentric grate assembly 40 mounted on a shaft 41 rotatably supported below the base wall of the lower chamber 24. The shaft 41 also carries a scraper bar 42 having chains which serve to plough collected ash into a discharge chute 43 below lower chamber 24. A motor 44 is drivingly connected by chain 45 to the shaft 41 to effect rotation of both the grate assembly 40 and the scraper bar 42. A discharge auger 46 takes discharged ash from the chute 43, through a water seal provided at the bottom of that chute.

Figure 2:
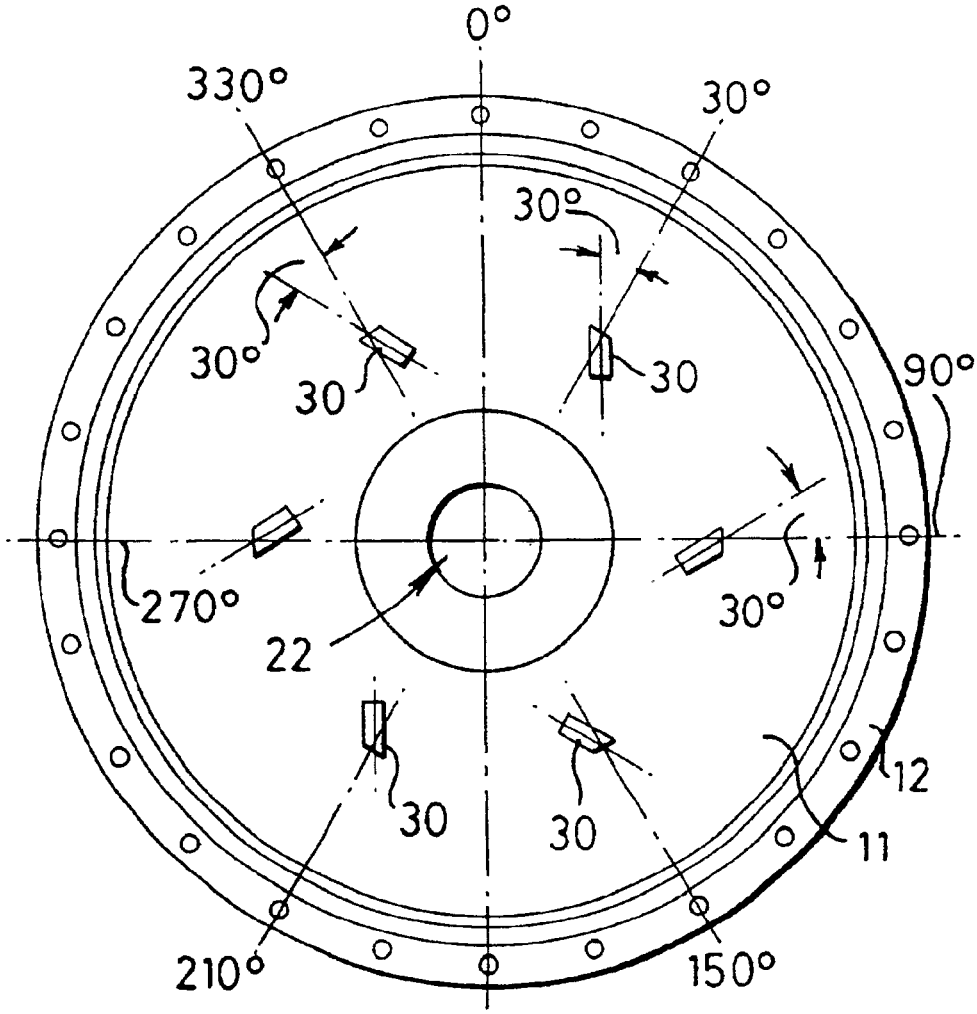
FIG. 2 is a plan view on the lower wall of the gasifier chamber shown in FIG. 1, with parts removed for clarity.

Air enters the plenum 17 through inlet 18 and passes into the combustion chamber 10 through a plurality of tuyères 30, provided in the conical lower wall 11 of the chamber. As best seen in FIG. 2, six such tuyères 30 are provided, equi-spaced around the opening 22 in alignment with the lighting ports 19. The tuyères all lie at substantially the same angle to the vertical axis 31 of the combustion chamber 10 and also all lie at substantially the same angle to a horizontal radius of the chamber intersecting the respective tuyère. Thus, air entering the combustion chamber will tend to swirl around the chamber in a counter-clockwise direction and at the same time to rise upwardly within the chamber.

Each tuyère 30 is fitted with an insert 33 so as to impart a spin on the jet of air issuing from the tuyère into the combustion chamber 10. The insert is in the form of a plate having a width substantially equal to the diameter of the tuyère, as shown in FIG. 4, and is twisted through 90° along its length. In this way, the air passing through the tuyère will be caused to swirl about the axis of the tuyère.

In operation, solid fuel pieces are loaded into the hopper 13 through the slide valve assembly 15 and then the air flow is commenced by reducing the pressure at the producer gas outlet 25. This draws air through inlet 18 into the plenum 17, the air then swirling around that plenum 17 and assisting cooling of the lower plate 11, when operation of the gasifier has been established. From the plenum 17, the air is drawn through the tuyères 30 into the bed on the lower wall 11 and down through opening 22, tube 23 and into the lower chamber 24 by the reduced pressure at the producer gas outlet 25. The gasifier is lit through at least one of the ports 19, for example with a gas torch, and the combustion within the chamber 10 is established. When fully operational, the upper region 35 of the gasifier will be at around 500° C. and will serve as a distillation zone for high molecular weight hydrocarbons. Below that, there is a carbonisation zone 36 operating at around 600° C., where the solid fuel is converted to charcoal, by burning off other matter. On and immediately above the lower wall 11, there is established an oxidation zone 37, operating at around 1200° C., where the carbon is burned in air to form $CO_2$. The hot carbon then falls through opening 22 into tube 23 and on to grate 40, there being a deficiency of oxygen in the tube 23 to continue the combustion of the carbon and so a reduction process takes place, reducing the $CO_2$ to CO. The final producer gas mixture leaves the lower chamber 24 through pipe 25.

During operation of the gasifier, the motor 47 is operated intermittently slowly to drive the grate assembly 40. The eccentricity of this assembly grinds any large pieces which then fall through the lower chamber 24 and are ploughed into the discharge chute 43. The motor may be operated continuously, depending upon the ash content of the fuel source.

A typical producer gas composition obtained from using wood as a fuel source may be as follows:

| GAS | % by weight |
|---|---|
| Nitrogen | 45–54 |
| carbon monoxide | 18–25 |
| hydrogen | 13–15 |
| water vapour | 10–15 |
| carbon dioxide | 5–10 |
| methane | 3–5 |

By adopting the measures as described above concerning the disposition of the tuyères and also the internal configuration thereof, and so improving the introduction of air into the oxidation zone through the tuyères, it is found the carbon dioxide content may significantly be reduced, with a consequent improvement in the carbon monoxide content of the producer gas.

What is claimed is:

1. A gasifier for the production of producer gas from combustible material, comprising a chamber into which said material is introduced and a plurality of tuyères disposed at or adjacent the lower end of the chamber for the introduction of air into the combustion chamber, each such tuyère defining an axis along which air is projected into the chamber, at least some of the tuyères being configured to impart a rotational motion about said axis along which the air is projected into the chamber from each such tuyère, whereby the combustion air is projected in the form of a jet stream which swirls about the length of the stream.

2. A gasifier as claimed in claim 1, wherein at least some of the tuyères are disposed with their respective axes at an acute angle (when projected on to a horizontal plane containing the respective tuyère) to a tangent to the wall of the chamber at the location of that tuyère, the axis of projection of each said tuyère being in the same sense with respect to the axis of the chamber, whereby the projected air also tends to swirl around the chamber.

3. A gasifier as claimed in claim 2, wherein said at least some of the tuyères lie at substantially the same acute angle to the respective tangents to the chamber wall at the location of the respective tuyères.

4. A gasifier as claimed in claim 2, wherein said axis of projection of each tuyère is directed upwardly of the chamber in addition to being directed with its axis at an acute angle to a tangent of the wall when projected on a horizontal plane containing that tuyère.

5. A gasifier as claimed in claim 1, wherein all of said tuyères are similarly configured and disposed with respect to the chamber.

6. A gasifier as claimed in claim 1, wherein the chamber is generally of circular cross-sectional shape at least in the region of the tuyères with the axis of the chamber extending generally vertically.

7. A gasifier as claimed in claim 6, wherein the gasifier chamber has a lower wall of generally conical shape which supports a bed of the combustible material, said tuyères being mounted in the lower wall.

8. A gasifier as claimed in claim 1, wherein said tuyères are distributed substantially uniformly around the chamber.

9. A gasifier as claimed in claim 1, wherein each said tuyères includes a nozzle which projects through the chamber wall, the bore of the nozzle being configured to cause the air flow therethrough to rotate about said axis of the tuyère.

10. A gasifier as claimed in claim 9, wherein an insert is provided within each said nozzle, the insert comprising a plate the width of which is substantially the same as the nozzle diameter and the plate being twisted along is length.

11. A method of operating a gasifier for the production of producer gas from combustible material, which gasifier comprises a chamber into which said material is introduced and a plurality of tuyères disposed at or adjacent the lower end of the chamber, in which method air is introduced into the combustion chamber through the tuyères and each tuyère is configured to impart a rotational motion about the axis of introduction of the air so that the combustion air is projected in the form of a jet stream which swirls about the length of the introduced stream.

12. A method as claimed in claim 11, wherein the tuyères are disposed with their respective axes at substantially the same acute angle (when projected onto a horizontal plane containing the respective tuyère) and in the same sense to a tangent to a wall of the chamber at the location of that tuyère whereby air introduced to the chamber through the tuyères tends to swirl around the chamber.

13. A method as claimed in claim 11, wherein the air is drawn through the tuyères by reducing the pressure at the producer gas outlet of the gasifier.

14. A method as claimed in claim 12, wherein the air is drawn through the tuyeres by reducing the pressure at the producer gas outlet of the gasifier.

15. A gasifier as claimed in claim 3, wherein said axis of projection of each tuyere is directed upwardly of the chamber in addition to being directed with its axis at an acute angle to a tangent of the wall when projected on a horizontal place containing that tuyere.

16. A gasifier as claimed in claim 7, wherein said tuyeres are distributed substantially uniformly around said chamber and each said tuyere includes a nozzle which projects through the chamber wall, the bore of the nozzle being configured to cause the air flow therethrough to rotate about said axis of the tuyere.

* * * * *